US012239875B2

(12) United States Patent
Gregory

(10) Patent No.: US 12,239,875 B2
(45) Date of Patent: Mar. 4, 2025

(54) FITNESS TRAINING APPARATUS AND SYSTEM

(71) Applicant: VITRUVIAN INVESTMENTS PTY LTD, Perth (AU)

(72) Inventor: Jonathan Charles Gregory, Nedlands (AU)

(73) Assignee: VITRUVIAN INVESTMENTS PTY LTD, Perth (AU)

( * ) Notice: Subject to any disclaimer, the term of this patent is extended or adjusted under 35 U.S.C. 154(b) by 0 days.

(21) Appl. No.: 18/582,441

(22) Filed: Feb. 20, 2024

(65) Prior Publication Data

US 2024/0189655 A1 Jun. 13, 2024

Related U.S. Application Data

(63) Continuation of application No. 17/559,060, filed on Dec. 22, 2021, now abandoned, which is a (Continued)

(30) Foreign Application Priority Data

Sep. 10, 2019 (AU) ..... 2019903351

(51) Int. Cl.
*A63B 21/00* (2006.01)
*A63B 21/005* (2006.01)
(Continued)

(52) U.S. Cl.
CPC ..... *A63B 21/4033* (2015.10); *A63B 21/0058* (2013.01); *A63B 21/153* (2013.01);
(Continued)

(58) Field of Classification Search
CPC ..... A63B 21/00047; A63B 21/00058; A63B 21/00069; A63B 21/00076; A63B 21/002;
(Continued)

(56) References Cited

U.S. PATENT DOCUMENTS 3,387,493 A 6/1968 Strittmatter
3,861,215 A 1/1975 Bradley
(Continued)

FOREIGN PATENT DOCUMENTS

CN 109890467 A 6/2019
CN 110180124 A 8/2019
(Continued)

OTHER PUBLICATIONS

Canadian Office Action for Application No. 3,153,042, dated Dec. 8, 2023 (5 pages).
(Continued)

*Primary Examiner* — Gary D Urbiel Goldner
(74) *Attorney, Agent, or Firm* — Michael Best & Friedrich LLP

(57) ABSTRACT

A fitness training apparatus comprises a base having an upper surface configured to support a user during a workout with the fitness training apparatus, a first retractable line extendable by the user upward from the base against a variable load from a first direct drive motor and retractable to wind up on a first spool or drum, and a second retractable line extendable by the user upward from the base against a variable load from a second direct drive motor and retractable to wind up on a second spool or drum. The first and second direct drive motors lie flat in the base with respective vertical axes and are provided in separate halves of the base. The first and second direct drive motors act independently on the first and second retractable lines and respectively spool the first and second retractable lines in mirror image in top plan view.

19 Claims, 6 Drawing Sheets

Related U.S. Application Data continuation of application No. 17/235,674, filed on Apr. 20, 2021, now Pat. No. 11,235,195, which is a continuation of application No. PCT/AU2020/050950, filed on Sep. 9, 2020.

(51) Int. Cl.
*A63B 23/04* (2006.01)
*A63B 24/00* (2006.01)

(52) U.S. Cl.
CPC ..... *A63B 23/0458* (2013.01); *A63B 24/0062* (2013.01); *A63B 24/0087* (2013.01); *A63B 2024/0093* (2013.01); *A63B 2208/0204* (2013.01); *A63B 2208/0228* (2013.01); *A63B 2208/0242* (2013.01); *A63B 2220/51* (2013.01); *A63B 2220/833* (2013.01)

(58) Field of Classification Search
CPC ..... A63B 21/0023; A63B 21/005; A63B 21/0058; A63B 21/0059; A63B 21/15; A63B 21/151; A63B 21/153; A63B 21/154; A63B 21/155; A63B 21/156; A63B 21/157; A63B 21/22; A63B 21/4027; A63B 21/4029; A63B 21/4033; A63B 21/4035; A63B 21/4045; A63B 21/4047; A63B 21/4049; A63B 23/0458; A63B 24/0062; A63B 24/0087; A63B 2024/0065; A63B 2024/0093; A63B 71/0619; A63B 71/0622; A63B 2071/065; A63B 2071/0675; A63B 2071/0694; A63B 2208/0204; A63B 2208/0228; A63B 2208/0242; A63B 2210/00; A63B 2210/50; A63B 2220/10; A63B 2220/20; A63B 2220/24; A63B 2220/30; A63B 2220/34; A63B 2220/36; A63B 2220/50; A63B 2220/51; A63B 2220/54; A63B 2220/58; A63B 2220/80; A63B 2220/83; A63B 2220/833; A63B 2225/09; A63B 2225/093; A63B 2225/50
See application file for complete search history.

(56) References Cited

U.S. PATENT DOCUMENTS

| | | | |
|---|---|---|---|
| 4,842,274 | A | 6/1989 | Oosthuizen et al. |
| 4,848,152 | A | 7/1989 | Pratt, Jr. |
| 4,912,638 | A | 3/1990 | Pratt, Jr. |
| 4,979,733 | A | 12/1990 | Prud'Hon |
| 5,015,926 | A | 5/1991 | Casler |
| 5,271,416 | A | 12/1993 | Lepley |
| 5,304,104 | A | 4/1994 | Chi |
| 5,312,309 | A | 5/1994 | Fox |
| 5,328,429 | A | 7/1994 | Potash et al. |
| 5,433,678 | A | 7/1995 | Chi |
| 5,476,428 | A | 12/1995 | Potash et al. |
| 5,643,157 | A | 7/1997 | Seliber |
| 5,713,792 | A | 2/1998 | Ohzono et al. |
| 6,280,361 | B1 | 8/2001 | Harvey et al. |
| 8,287,434 | B2 | 10/2012 | Zavadsky et al. |
| 8,900,099 | B1 | 12/2014 | Boyette |
| 9,539,458 | B1 | 1/2017 | Ross |
| 9,884,220 | B2 | 2/2018 | Smith et al. |
| 10,335,626 | B2 | 7/2019 | Orady et al. |
| 10,456,614 | B1 | 10/2019 | Dube et al. |
| 10,486,015 | B2 | 11/2019 | Valente et al. |
| 10,589,163 | B2 | 3/2020 | Orady et al. |
| 10,617,903 | B2 | 4/2020 | Orady et al. |
| 10,661,112 | B2 | 5/2020 | Orady et al. |
| 10,792,539 | B1 | 10/2020 | Gilstrom et al. |
| 10,874,905 | B2 | 12/2020 | Belson et al. |
| 10,881,890 | B2 | 1/2021 | Orady et al. |
| 10,918,899 | B2 | 2/2021 | Gisin et al. |
| 11,235,195 | B2 | 2/2022 | Gregory |
| 2003/0013585 | A1 | 1/2003 | Chen |
| 2007/0026973 | A1 | 2/2007 | Johnson et al. |
| 2009/0114892 | A1 | 5/2009 | Lesko |
| 2010/0227744 | A1 | 9/2010 | Dang |
| 2012/0053014 | A1 | 3/2012 | Zhu |
| 2013/0090216 | A1 | 4/2013 | Jackson |
| 2013/0267384 | A1 | 10/2013 | Eldridge |
| 2013/0288864 | A1 | 10/2013 | Holland |
| 2013/0310230 | A1 | 11/2013 | Norris |
| 2014/0038777 | A1 | 2/2014 | Bird |
| 2014/0194250 | A1 | 7/2014 | Reich et al. |
| 2014/0194251 | A1 | 7/2014 | Reich et al. |
| 2014/0287876 | A1 | 9/2014 | Etter et al. |
| 2016/0166460 | A1 | 6/2016 | Murphy et al. |
| 2016/0243396 | A1 | 8/2016 | Taylor et al. |
| 2017/0234350 | A1 | 8/2017 | Rudduck et al. |
| 2018/0001128 | A1 | 1/2018 | Norris |
| 2018/0021616 | A1 | 1/2018 | Orady et al. |
| 2018/0214729 | A1 | 8/2018 | Rubin et al. |
| 2018/0214730 | A1 | 8/2018 | Larose et al. |
| 2019/0046830 | A1 | 2/2019 | Chiavegato et al. |
| 2019/0099632 | A1 | 4/2019 | Orady et al. |
| 2019/0099633 | A1 | 4/2019 | Orady et al. |
| 2019/0099637 | A1 | 4/2019 | Valente et al. |
| 2019/0344115 | A1 | 11/2019 | Neuhaus et al. |
| 2019/0344123 | A1 | 11/2019 | Rubin et al. |
| 2019/0366141 | A1 | 12/2019 | Cylvick |
| 2020/0047055 | A1 | 2/2020 | Ward et al. |
| 2020/0054914 | A1 | 2/2020 | Lafrance et al. |
| 2020/0070032 | A1 | 3/2020 | Orady et al. |
| 2021/0236876 | A1 | 8/2021 | Gregory |
| 2021/0244995 | A1 | 8/2021 | Andrei et al. |
| 2022/0111245 | A1 | 4/2022 | Gregory |

FOREIGN PATENT DOCUMENTS

| | | | |
|---|---|---|---|
| CN | 110270048 | A | 9/2019 |
| CN | 113616976 | A | 11/2021 |
| DE | 102013010499 | A1 | 1/2015 |
| GB | 148953 | A | 10/1921 |
| GB | 2562486 | A | 11/2018 |
| JP | 2009131347 | A | 6/2009 |
| WO | 2015137566 | A1 | 9/2015 |
| WO | 2016086264 | A1 | 6/2016 |
| WO | 2021154298 | A1 | 8/2021 |
| WO | 2022165551 | A1 | 8/2022 |
| WO | 2023087059 | A1 | 5/2023 |

OTHER PUBLICATIONS

Chinese First Office Action for Application No. 202080062726.1, dated Mar. 9, 2023 (11 pages, including translation).
Chinese Second Office Action for Application No. 202080062726.1, dated Sep. 25, 2023 (25 pages, including translation).
International Search Report and Written Opinion for Application No. PCT/AU2022/050055, dated Apr. 13, 2022 (10 pages).
International Search Report and Written Opinion for Application No. PCT/AU2022/051372, dated Feb. 22, 2023 (11 pages).
International Search Report in Priority Application No. PCT/AU2020/050950, dated Oct. 29, 2020 (4 pages).
Maccon pancake (direct drive) motors at https://www.maccon.com/pancake-motors.html, version dated Oct. 28, 2021 (4 pages).
Singapore Search Report and Written Opinion for Application No. 11202201592Y, dated Jan. 17, 2024 (9 pages).

FITNESS TRAINING APPARATUS AND SYSTEM

CROSS-REFERENCE TO RELATED APPLICATIONS

This application is a continuation of U.S. application Ser. No. 17/559,060, filed on Dec. 22, 2021, which is a continuation of U.S. application Ser. No. 17/235,674, filed on Apr. 20, 2021, which is a continuation of international application PCT/AU2020/050950, filed on Sep. 9, 2020, which claims priority to AU2019903351, filed on Sep. 10, 2019. The entire contents of the above-identified applications are hereby incorporated by this reference.

FIELD OF THE INVENTION

The present invention relates to a fitness training apparatus and an associated fitness training system.

BACKGROUND OF THE INVENTION

Fitness training for maintenance and improvement of personal health and well-being has become increasingly popular in developed societies in the past several years. And during this period, there have also been accompanying developments in equipment and apparatuses for training popular exercises, such as running, cycling and rowing. In particular, a wide variety of treadmills, training cycles, and rowing machines have been developed for use both in the home and in fitness studios for individual or group training classes.

One area of fitness training that has perhaps experienced less development in new equipment and apparatuses for popular exercises is weight-training. In this regard, free-weights (such as dumbbells, barbells, and kettlebells) are still common in fitness studios. And although a wide variety of different weight-machines are also known, each of these is usually designed for performing only a small and specific group of exercises, making a collection of different weight-machines necessary for a general or "all-round" workout.

A need therefore exists for a new and improved fitness training apparatus that is able to replace or substitute for a variety of known weight-training equipment. It would also be desirable to provide such an apparatus that could be used in a group or class training environment and/or in an internet-enabled connected fitness environment. In view of the above, it would be useful to provide a new and improved fitness training apparatus and an associated fitness training system.

SUMMARY OF INVENTION

According to one broad aspect, the present invention provides a fitness training apparatus comprising a base; at least one retractable line provided in or on the base, the retractable line having a free end region for operation by a user, wherein the at least one retractable line is configured and arranged to be extended from a retracted state in or on the base to an extended state upon application of a force to the free end region of the retractable line by the user; and a load generator provided in or on the base for applying a selectively adjustable load to the at least one retractable line, wherein the load applied to the retractable line by the load generator resists or acts against the force applied to the free end region by the user for extending the retractable line from the retracted state to the extended state In this way, the invention provides a fitness training apparatus with at least one retractable line with which a user can perform exercises against a selectively adjustable load provided by the load generator. In particular, the force typically required, in use, for application to the free end region by the user for extending the retractable line from the retracted state to the extended state exceeds the load being applied to the retractable line by the load generator. Also, the at least one retractable line is preferably configured to be retracted from the extended state to the retracted state by the load applied by the load generator. Accordingly, in use, the force applied to the retractable line by the user while performing exercises will typically oppose and/or resist the load being applied by the load generator for retracting the retractable line to the retracted state.

In a preferred embodiment, the base of the fitness training apparatus is adapted or designed for supporting the apparatus on a support surface, which may, for example, be the floor of a training room. In this context, the base may include wheels or casters to assist a user to move the apparatus over the floor of a training room. Depending on the intended use of the training apparatus, however, the base may be adapted or designed for supporting the apparatus on a vertical support surface, such as a wall. In this regard, the base may be configured to be securely fixed or mounted to the support surface.

In a preferred embodiment, the base of the fitness training apparatus provides a training platform for the user. In this regard, the base may be configured to support the user while he/she is performing training exercises. In other words, the user may stand, sit, or lie on the base as a training platform while performing training exercises. In a particularly preferred embodiment, the base or training platform is configured as a step or platform upon which a user may stand while performing training exercises. The step has a height that is preferably in the range of about 100 mm to about 400 mm, more preferably in the range of about 200 mm to about 300 mm. In this way, the at least one retractable line is preferably configured and arranged to be extended from the retracted state in a direction away from the base, preferably in an upwards or vertical direction, or through any of a range of angles to the vertical direction.

In a preferred embodiment, the base of the fitness training apparatus includes a portion that is removable or separable to form a training bench for the user. The portion of the base for forming the training bench preferably has a length in the range of about 500 mm to about 1000 mm. The portion of the base for forming the training bench also preferably has foldable legs.

In a preferred embodiment, the base of the fitness training apparatus includes a frame for mounting and supporting the load generator thereon and a casing to enclose and house the load generator and the at least one retractable line in its retracted state.

In a preferred embodiment, the at least one retractable line is flexible and is arranged to retract into a wound or coiled configuration in the retracted state, preferably onto a spool or drum that is provided in or on the base, e.g. mounted and supported on the frame of the base. The at least one retractable line preferably comprises any one of a cable, a cord, a rope, a strap, or a band. The at least one retractable line is configured for attachment of a handle at the free end region thereof for manual operation by a user. To this end, the free end region of the retractable line may comprise a clip or clasp for attachment of a handle to be grasped by the user during training; i.e. for applying force (tension) to the retractable line as it is extended and retracted. The handle may have a hand-grip that is sized or configured for one-handed operation of the retractable line. As an alternative, the handle may have a hand-grip sized or configured for two-handed operation of the retractable line. The handle may also be provided in the form of a bar for connection with either a single retractable line, or with multiple retractable lines (e.g. with two retractable lines—one connected at each of the opposite ends of the bar).

In a preferred embodiment, the load generator of the fitness training apparatus comprises at least one electric motor, desirably a torque motor, that is variably operable to generate a range of torques for applying the selectively adjustable load to the at least one retractable line. A torque motor is a specialized form of electric (DC) motor that can operate while stalled, i.e. with the rotor prevented from turning. In this mode of operation the motor continues to apply a steady torque. In a preferred embodiment, the spool or drum on which the retractable line is wound or coiled in the retracted state is provided or mounted on a shaft coupled with a rotor of the at least one electric motor. The shaft may be coupled directly to the rotor or coupled via a transmission, e.g. a belt and pulley transmission or, more preferably, a toothed-belt (or chain) and sprocket transmission.

In a preferred embodiment, the load generator of the fitness training apparatus is configured or controlled to adjust the load applied to the at least one retractable line during extension of the retractable line to the extended state and/or during retraction of the retractable line to the retracted state. In this way, the load applied to the retractable line by the load generator (e.g. via the at least one electric motor) may be held constant, increased, and/or decreased as the line is extended under the force applied by the user and/or as the line is retracted against the resistance force applied by the user. The adjustability of the load over the stroke or movement of the retractable line in this way enables the training to be tailored not only to the individual person, but also to a specific exercise being trained and its associated biomechanics. Thus, the load generator can be controlled to provide eccentric loading, concentric loading, and/or isometric loading. In this regard, the fitness training apparatus preferably comprises a control device—e.g. provided in or on the base—having one or more sensor(s) for sensing use or operation of the or each retractable line, such as current position, motion, speed, force, and/or extension of each retractable line. The control device may be configured to adjust the load applied to the or each retractable line by the respective load generator in dependence upon the use or operation of the or each retractable line.

In a preferred embodiment, the control device is configured for communication with a user device, such as a smart phone and/or a display monitor, for input of training settings by the user and/or for displaying training information to the user during training. The control device preferably includes a processor, an electronic data storage, and/or wireless communication hardware.

In a particularly preferred embodiment, the fitness training apparatus comprises two retractable lines provided in or on the base, and two load generators provided in or on the base, each load generator being operatively associated with a respective one of the two retractable lines. The retractable lines may be arranged spaced apart from one another by a distance in the range of about 0.8 m to 1.6 m, preferably about 1.0 m to 1.4 m, especially where the base is configured as a step or platform upon which a user may stand while performing training exercises. The base may be adjustable to vary the distance by which the retractable lines are spaced apart from one another.

Thus, according to at least one embodiment, the present invention provides a fitness training apparatus comprising: a base configured as a platform upon which a user may stand while performing training exercises; two retractable lines provided in or on the base, each retractable line having a free end region for operation by a user, wherein each retractable line is configured and arranged to be extended from a retracted state in or on the base to an extended state upon application of a force to the free end region of the respective retractable line by the user; and two load generators provided in or on the base, each load generator being operatively associated with a respective one of the two retractable lines, for applying a selectively adjustable load to each retractable line, wherein the load applied to each retractable line by the respective load generator resists or acts against the force applied in use to the free end region by the user for extending the retractable line from the retracted state to the extended state.

In a preferred embodiment, each retractable line is provided or incorporated in the base, with the free end of each retractable line emerging from an outer (e.g. upper) surface of the base for access and operation by the user. A path of travel of each retractable line is guided by one or more pulleys mounted in or on the base. A pulley for guiding the path of travel of each retractable line into the retracted state is preferably configured to pivot or swivel to promote even spooling of the line as it retracts.

According to another aspect, the present invention provides a fitness training system comprising: a fitness training apparatus of the invention as described above, and according to any one of the embodiments; and a user device, such as a smart phone or a display monitor, for communication with the apparatus, preferably with a control device of the apparatus, for input of training settings by the user and/or for displaying training information to the user during training.

The fitness training system of the invention is thus preferably internet-enabled, via the fitness training apparatus (e.g. the control device of the apparatus) itself or via the user device, such as smart phone and/or display monitor, with which the user device is in communication. In this way, the system may connect a user to an interactive fitness environment. For example, the user may receive audio and/or visual input for one or more training regime via the user device. Furthermore, the user may be connected via the user device to a group or class training environment—either real or virtual.

In a preferred embodiment, the fitness training system comprises a software application for installation on the user device for communication with the apparatus for input of training settings and/or for display of training information to the user. In this way, the software application is configured to provide a user of the fitness training apparatus with user input (i.e. audio and/or visual user input) during use of the apparatus. This input may, for example, be in the form of instruction and/or motivation for any one of a number of specific training regimes. To this end, the control device of the fitness training apparatus and/or the user device is preferably configured for connection to the internet for either or both of: downloading information for display to the user via the user device, and uploading information from the apparatus and/or from the user's training area for display to the user and/or for transmission to co-participants in a group or class training environment.

The fitness training system of the invention is therefore preferably configured to enhance the overall training experience for the user by connecting the user with training instruction, with training motivation, and/or with a group or class training environment—whether real or virtual.

In a preferred embodiment, the fitness training system comprises one or more accessory devices for user input (such as a camera and/or a microphone) and/or for output to the user (such as speakers and/or lighting). The accessory devices may be integrated in the user device or may be separate. The fitness training system may also include a remote control (e.g. in addition to touch-screen actuation), optionally with IR input, and power/volume control in order for the user to operate the user device and/or accessory device(s) remotely during use of the fitness training apparatus.

In a preferred embodiment, the control device of the apparatus is configured to calculate training performance from the use or operation of the or each retractable line sensed or detected by one or more sensor(s) of the control device for display on the user device. In this way, the control device may output information to the user device for display to the user during training, thereby providing useful training feedback.

BRIEF DESCRIPTION OF THE DRAWINGS

For a more complete understanding of the invention and advantages thereof, exemplary embodiments of the invention are explained in more detail in the following description with reference to the accompanying drawing figures, in which like reference signs designate like parts and in which.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will also be understood that certain actions and/or steps in an embodiment of a method may be described or depicted in a particular order of occurrences while those skilled in the art will understand that such specificity with respect to sequence is not actually required.

DETAILED DESCRIPTION OF THE EMBODIMENTS

Figure 1:
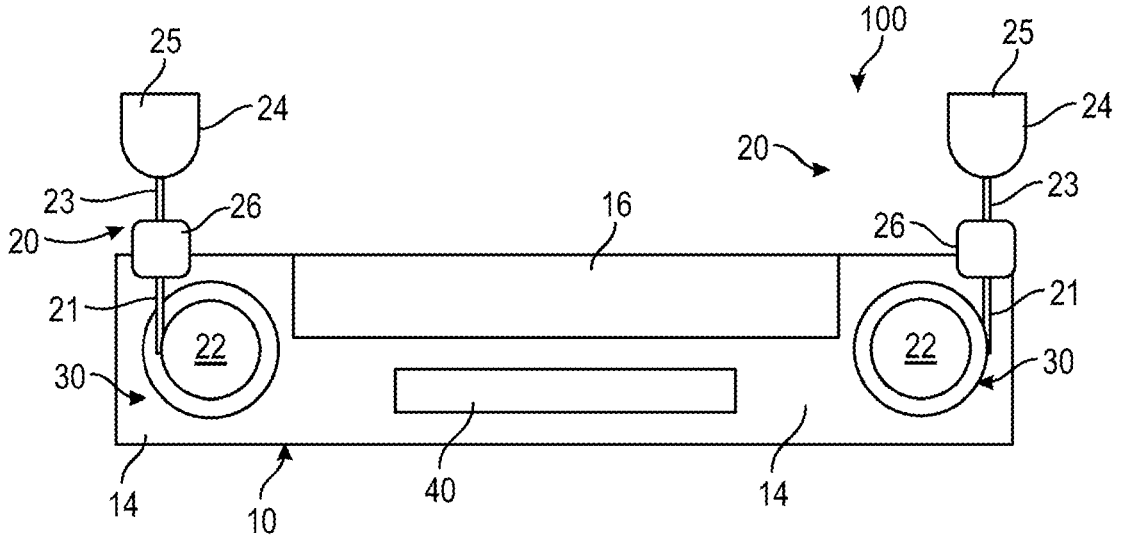
FIG. 1 is a schematic cross-sectional view of a fitness training apparatus according to one preferred conceptual embodiment of the invention.
Figure 2:
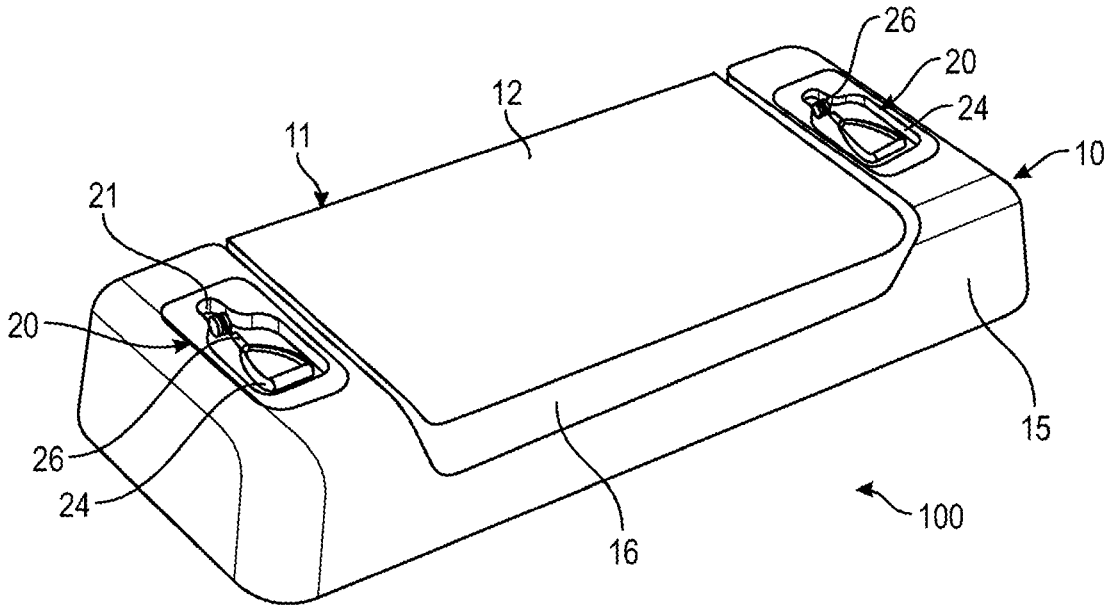
FIG. 2 is a perspective view of a fitness training apparatus according to a preferred embodiment of the invention.
Figure 3:
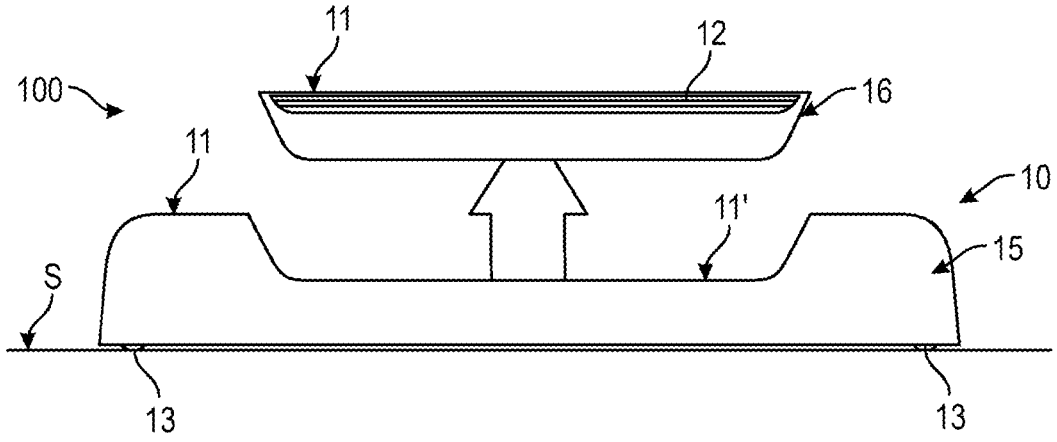
FIG. 3 is a front view of the fitness training apparatus of FIG. 2, illustrating separation of an upper portion of the base.
Figure 4:
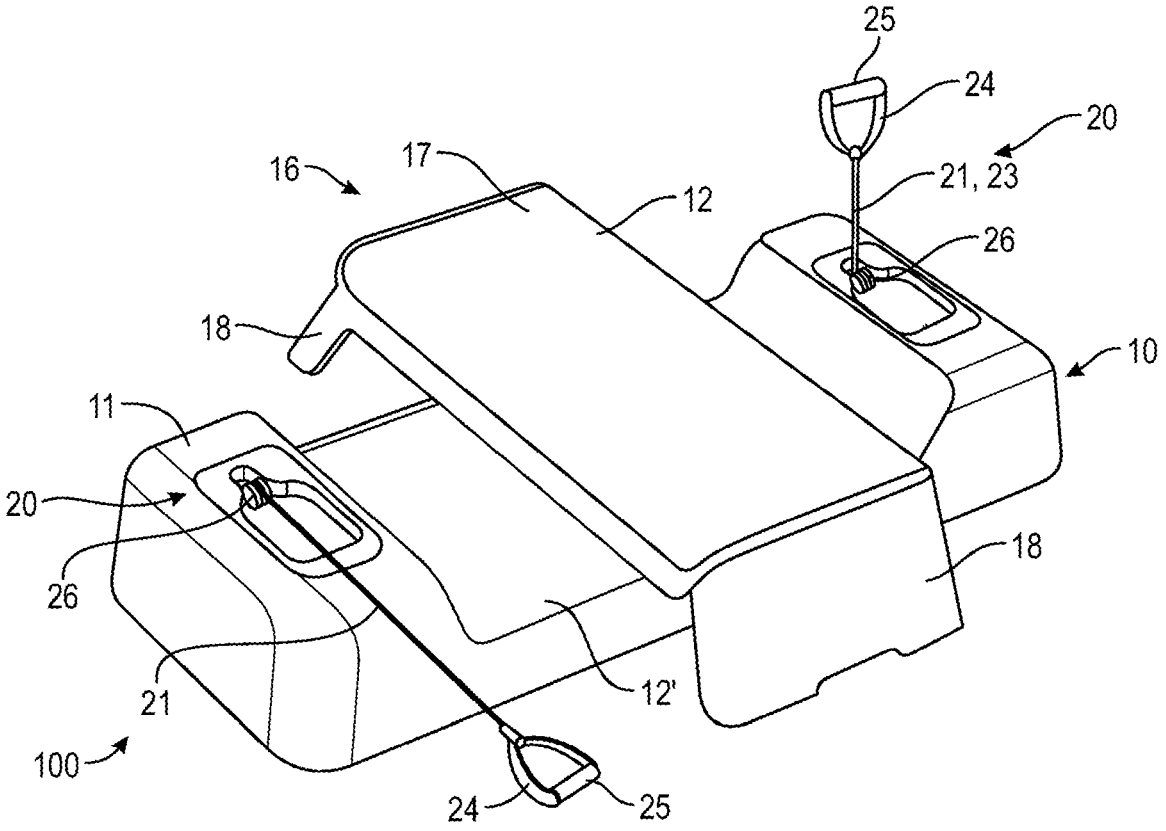
FIG. 4 is a perspective view of the fitness training apparatus of FIG. 2, showing the upper portion of the base converted into a bench.

With reference to FIGS. 1 to 4 of the drawings, a fitness training apparatus 100 according to a preferred embodiment of the invention will be described with reference to both its conceptual design in FIG. 1 and a preferred configuration in FIGS. 2 to 4.

Referring firstly to the drawing FIGS. 1 and 2, the fitness training apparatus 100 comprises a base 10 configured as a platform or step upon which a user (not shown) may stand, sit, or lie while performing training exercises. An upper surface 11 of the base 10 has a layer 12 of rubberised material to provide grip and optionally also some degree of cushioning and/or comfort for the user when he or she stands, sits, or lies on the upper surface 11. In this example, the base 10 of the fitness training apparatus 100 is adapted or designed to support the apparatus on a generally horizontal support surface S, such as the floor of a training room. The base includes wheels or casters 13 which assist a user to move the apparatus 100 over the floor of a training room.

The fitness training apparatus 100 comprises two retractable lines 20 provided in the base 10. In this embodiment, each retractable line 20 comprises a thin, flexible cable 21 of a generally circular cross-section coated or covered with a plastic sheath, although a cord or rope may be equally suitable. Each retractable line 20 (i.e. cable 21) is configured and arranged to retract into a wound or coiled configuration in a retracted state on a spool or drum 22 provided in the base 10, i.e. mounted and supported on a frame 14 of the base 10. Each cable 21 typically has an unwound length of less than or equal to 2 metres. In this way, each retractable line 20 is provided in the base 10, with a free end region 23 of each retractable line or cable emerging from the upper surface 11 of the base 10 for access and operation by the user. To this end, the free end region 23 of each cable 21 is configured (e.g. with a clip or clasp) for removable attachment of a handle 24 for manual operation by the user. In this example, each of the handles 24 has a hand-grip 25 sized or configured for one-handed operation of the retractable line. In this way, each retractable line 20 is configured to be extended from the retracted state in the base 10 to an extended state upon application of a force (i.e. a tension force) to the free end region 23 of the respective retractable line 20 by the user. The retractable lines 20 are arranged in the base 10 spaced apart from one another by a distance in the range of about 1.0 m to 1.2 m, and preferably about 1.1 m, for comfortable ergonomic operation by each hand and/or arm of a user when the user is standing, sitting, or lying on the upper surface 11 of the base 10.

Still referring to FIGS. 1 and 2, the fitness training apparatus 100 also comprises two load generators 30 provided in the base 10, each of the load generators 30 being operatively associated with a respective one of the two retractable lines 20 for applying a selectively adjustable load to that retractable line 20. To this end, each load generator 30 of the fitness training apparatus 100 comprises at least one electric motor 31, such as a torque motor, that is variably operable to generate a range of torques for applying the selectively adjustable load to its respective retractable line 20. The spool or drum 22 upon which the retractable line 20 is wound or coiled in the retracted state is mounted on a shaft 32 coupled with a rotor of the at least one electric motor 31. The load applied to each retractable line 20 by the respective load generator 30 resists or acts against a force applied in use to the free end region 23 by the user for extending the retractable lines 20 from the retracted state to the extended state. In this way, a user of the fitness training apparatus 100 can perform exercises with the retractable lines 20 against a selectively adjustable load provided by the load generators 30. The force typically required, in use, for application to the free end region 23 by the user for extending each cable 21 from its retracted state to its extended state will exceed the load being applied to the cable 21 by the respective load generator 30. Also, because the cables 21 are configured to be retracted from their extended state to their retracted state by the load applied by the electric motors 31, force applied to the cables 21 by the user performing exercises will oppose and/or resist the load being applied by the motors 31 for retracting the retractable lines 20 to the retracted state.

With reference also now to FIGS. 3 to 4 of the drawings, it will be appreciated that the base 10 of the fitness training apparatus 100 in this embodiment has an internal frame 14 for mounting and supporting the retractable lines 20 (i.e. in the retracted state) and the load generators 30, and an outer casing 15 that presents the upper surface 11 of the base and encloses and houses the retractable lines 20 and load generators 30. As noted above, the base 10 in this embodiment is configured as a platform or step upon which the user may stand, sit, or lie while performing training exercises. The step has a height H in the range of about 100 mm to 300 mm, preferably about 200 mm. The length L of the step is in the range of about 1.2 m to 1.4 m, preferably about 1.3 m, and the depth D of the step is in the range of about 400 mm to 600 mm, preferably about 500 mm. The retractable lines 20 are configured and arranged to be extended from the retracted state in a direction away from the base 10, preferably in an upwards or vertical direction, or through any of a range of angles to the vertical direction, or horizontally, as seen in FIG. 4. To this end, a path of travel of each retractable line 20 is guided by one or more pulleys 26 mounted in or on the base 10.

The base 10 of the fitness training apparatus 100 includes a portion 16 that is removable or separable to form a training bench for the user. The separable portion 16 of the base 10 has a bench panel 17 incorporating the layer 12 of rubberised material that provides grip and a degree of cushioning and/or comfort for the user, and foldable legs 18 in hinged attachment to opposite ends of the bench panel 17 for deployment to support the bench as shown in FIG. 4. The bench panel 17 has length in the range of about 500 mm to about 800 mm, preferably 600 mm, and may include space for storing the handles 24 or bar of the apparatus 100 when they are not in use (e.g. underneath the bench panel 17). As shown in FIG. 4 of the drawings, the base 10 includes a secondary upper surface 11' with secondary layer 12' of rubberised material for grip and a degree of cushioning and/or comfort for the user in the region below the separable portion 16 recessed between opposite ends of the base 10 respectively housing each of the retractable lines 20 and the load generators 30.

With reference to now FIGS. 5 to 10 of the drawings, alternative configurations for the retractable line 20 and its coupling with the load generators 30 are illustrated. As noted above, each of the load generators 30 has at least one electric motor 31. In each of these embodiments, however, dual electric motors 31 (torque motors) are preferred. Dual, uncoupled motors 31 allow the apparatus 100 to adjust to a weaker side, as will be described later. Dual motors 31 also help with torque production, and each motor 31 need only generate half the amount of torque for the total load. The power output of the motors 31 is based on a requirement to move up to 100 kg by a distance of 2 metres in 1 second, thereby giving a power requirement of about 2 kW. Allowing for some losses, two motors with a maximum power output of 1.2 kW each are contemplated. Where the spool or drum 22 for the cable 21 has a diameter of 50 mm, a shaft speed of 764 rpm for the spool 22 will equate to a 2 m extension of the cable 21 in 1 second. The torque for a 50 mm spool equates to 12.5 Nm per motor. A 50 mm diameter spool 22 with a cable 21 having a diameter of 5 mm demands a spool length of approx. 65 mm (i.e. 12.7 wraps of cable 21 side-by-side). A smaller spool 22 may be considered for greater range of shaft speed (rpm), if required. The RMS constant torque value is deemed a suitable operating value (as opposed to peak torque). The diameters of the pulleys 25 are calculated to suit this torque target point, and a maximum user force of 1000 N.

Each of the drawing FIGS. 5 to 8 shows the dual electric motors 31 of the load generator 30 mounted on the frame 14 of the base 10 and coupled with the retractable line 20. The frame 14 comprises a plate 19 and elongate frame members 19' on which the retractable line 20 and the load generator 30 are mounted in the base 10.

Figure 5:
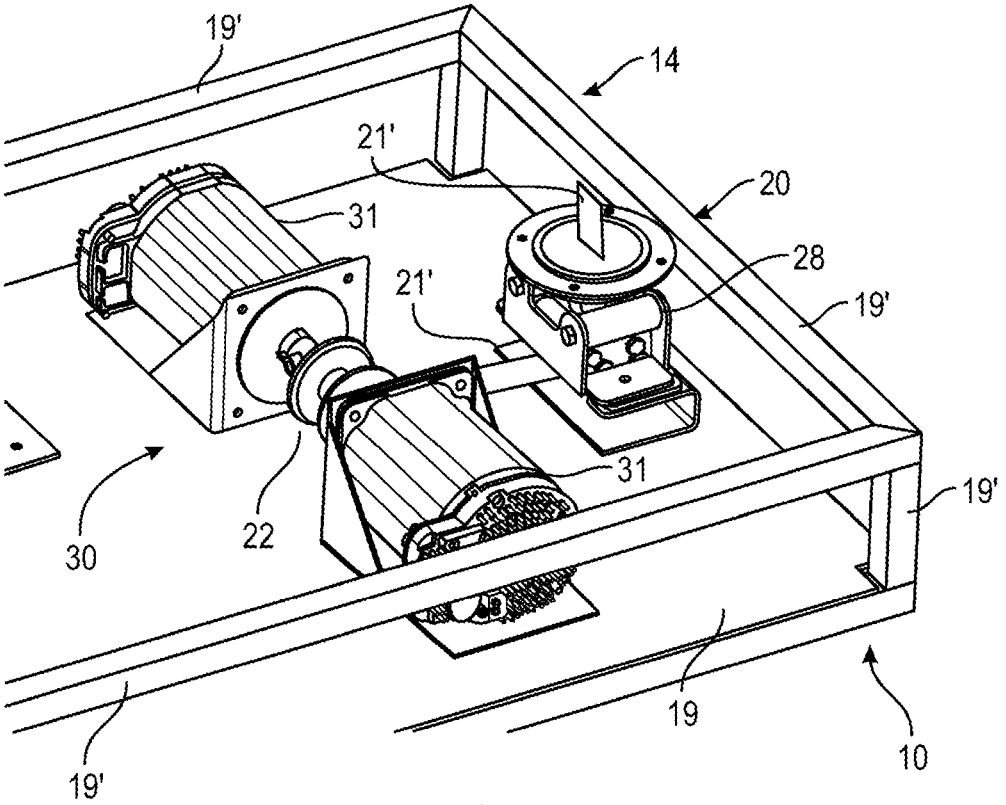
FIG. 5 is a perspective view of an interior of a base of the training apparatus according to one preferred embodiment.
Figure 6:
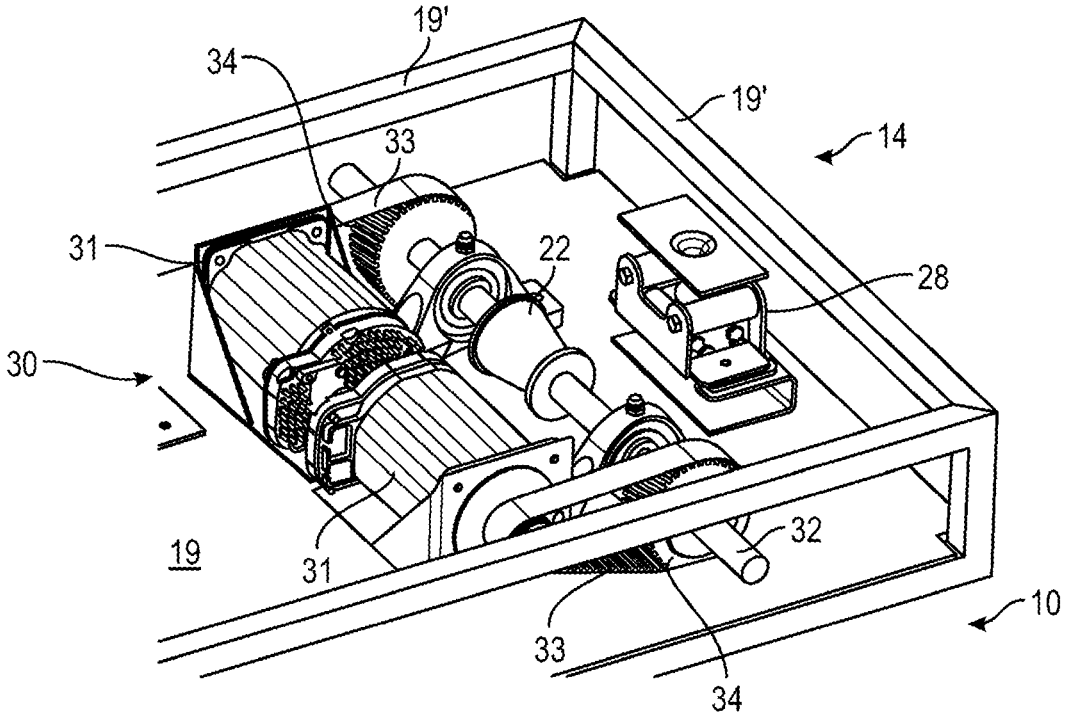
FIG. 6 is a perspective view of an interior of a base of the training apparatus according to another preferred embodiment.
Figure 7:
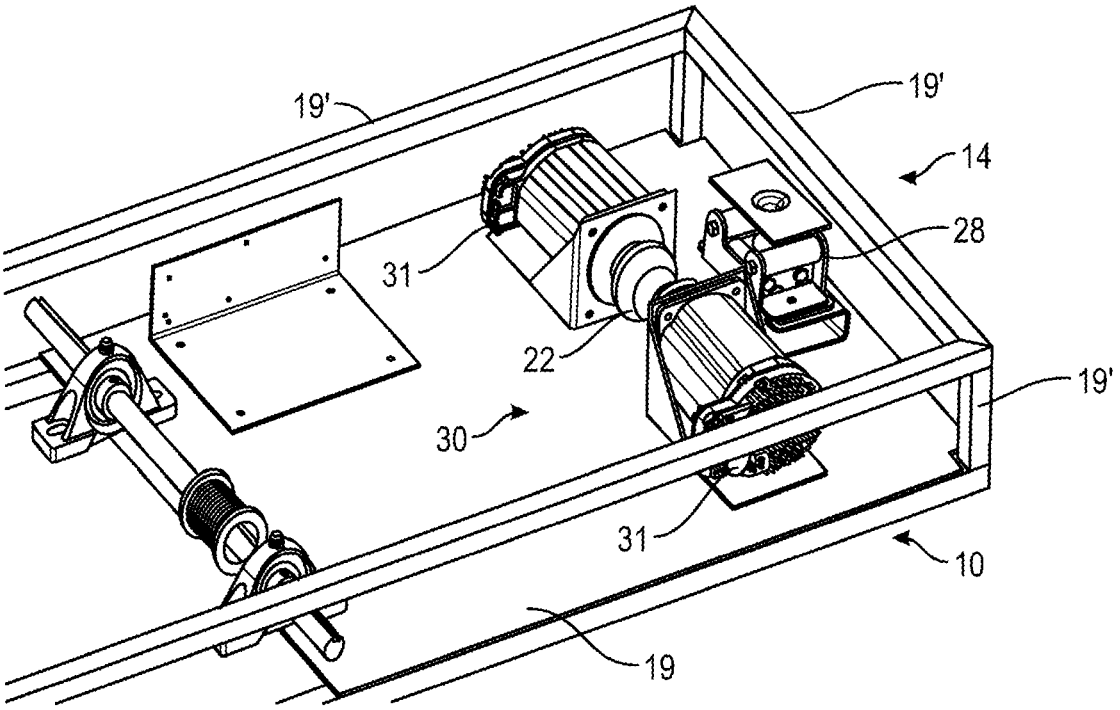
FIG. 7 is a perspective view of an interior of a base of the training apparatus according to a further preferred embodiment.

FIG. 5 shows an embodiment where the retractable line 20 comprises a flexible strap 21' instead of a cable 21. The strap 21' has the advantage of being a very flexible force translation material that can achieve a very small bend radius and has little or no chance of slip or movement when wound onto the spool or drum 22. The strap also provides a perception of smooth travel and quality as it is extended and retracted. However, as the strap winds on top of itself on the spool 22, the torque of the motors needs to vary as the diameter of the spool changes. The strap also has the potential for unwanted twisting, if not restrained. FIG. 6. shows an embodiment where the retractable line 20, and particularly the cable 21, is wound on a cone-shaped spool 22. The cable is circular in this example (i.e. as before) so there is no problem of inline twisting, as with strap. The cable 21 has a small profile and can be wound side-by-side, with the cone-shape promoting self-alignment of the cable on the spool 22. As such, there is no need for any inlet straightener, as required with the strap 21'. FIG. 7. shows an embodiment in which the cable 21 is wound via a capstan 27, which isolates the motors 31 of the load generator 30 from the spool. Again, the cable 21 is circular and therefore has little or no prospect of inline twisting, and the cable has a small profile for spooling side-by-side in a compact manner.

Figure 8:
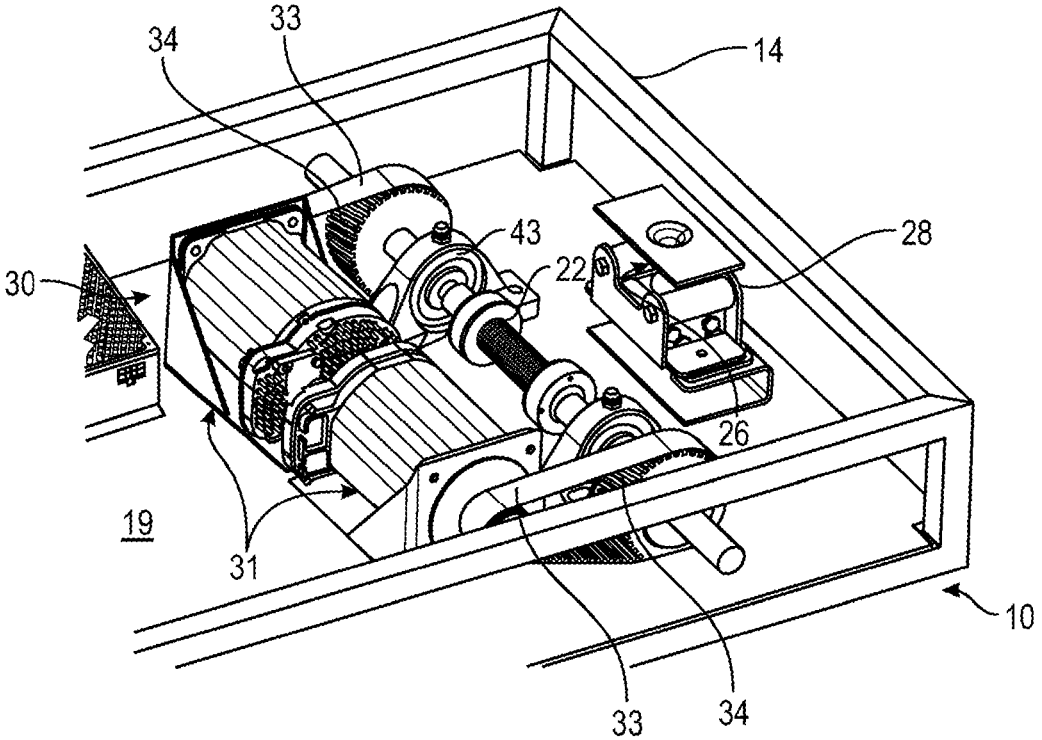
FIG. 8 is a perspective view of an interior of a base of the training apparatus according to yet another preferred embodiment.

FIG. 8 of the drawings shows an embodiment in which the retractable line 20, and particularly cable or cord 21, is wound on a helical spool 22. The spool 22 thus has a helical groove providing a positive location for each winding of cable and the cable 21 is circular with little chance of inline twisting. Further, the cable 21 has a small profile and can be spooled side-by-side, with no need for a varying load calculation. Due to the proximity of the helical spool 22 to the cable pre-tensioner 28, a relatively large angle of travel is required for spooling over the length of the spool 22. To this end, the guide pulley 26 at the pre-tensioner is arranged to pivot or swivel about a vertical axis to guide cable 21 along the spool 22 as it winds and unwinds to prevent 'jumping' or overwinding of the cable 21 on spool 22 to achieve even spooling and no jamming/wedging. This embodiment is further illustrated in FIGS. 9 and 10. In this embodiment, the spool 22 is mounted on the shaft 32 coupled with the rotors of each motor 31 via a transmission, particularly a transmission comprising a toothed-belt (or chain) 33 and sprocket 34.

Figure 9:
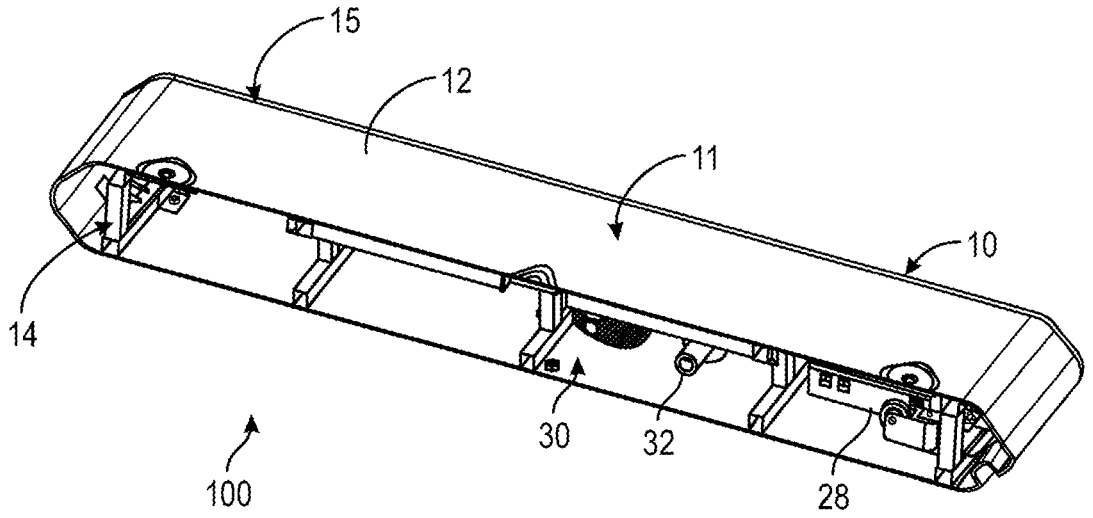
FIG. 9 is a cross-sectional perspective view of a fitness training apparatus according to the embodiment of FIG. 8.
Figure 10:
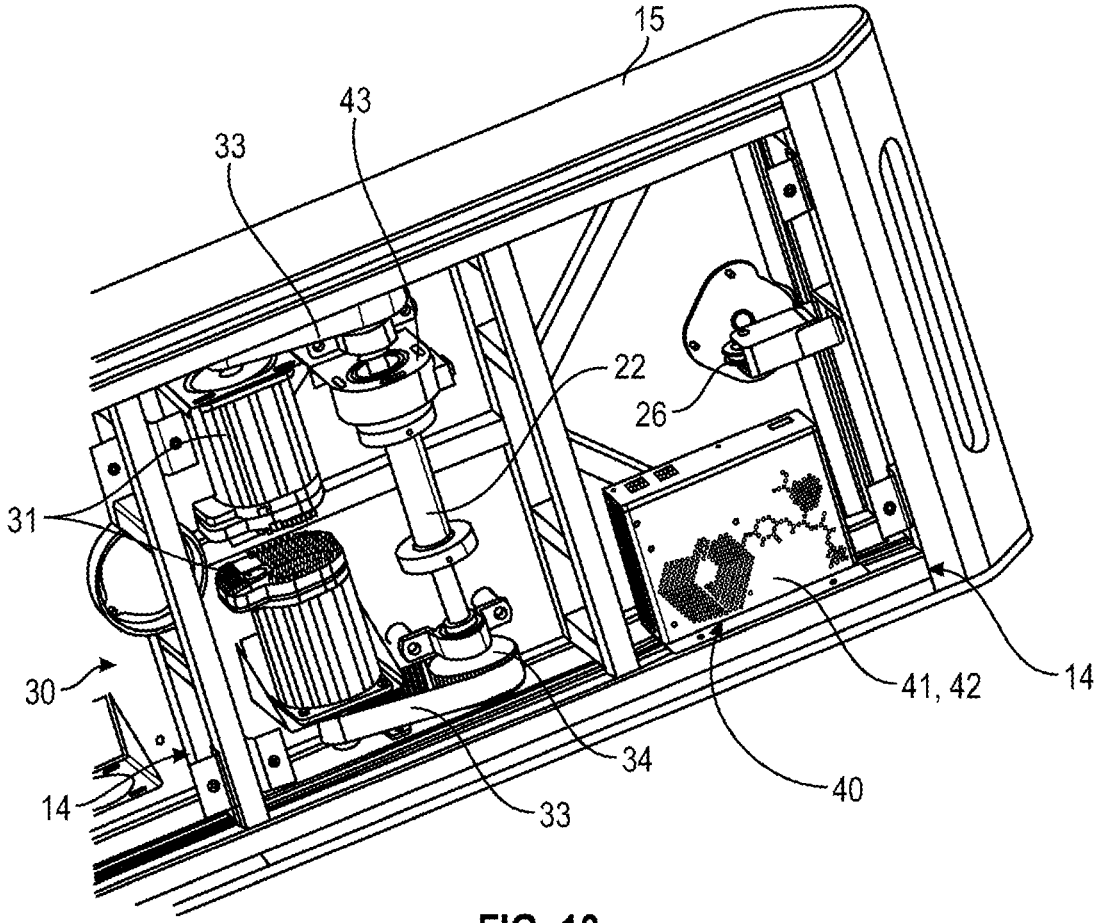
FIG. 10 is a partial perspective underside view of the fitness training apparatus shown in FIG. 9.

As will be seen in FIGS. 8 to 10 (and in FIG. 1), the fitness training apparatus 100 also has a control device 40 mounted or supported on the frame 14 of the base 10. The control device 40 includes a power supply circuit and hardware 41, a processor 42, wireless communication hardware, and one or more sensors 43 for sensing the use or operation of each retractable line 20. The sensors 43 include a rotary encoder (e.g. a Broadcom incremental encoder module, 500 CPR) for sensing/detecting rotation of the spool 22 for determining the position and speed of movement of each cable 21 as it is extended from or retracted onto its spool 22. The control device 40 is configured to adjust the load applied to each cable 21 by the motors 31 of the load generators 30 in dependence upon the use or operation of each retractable line 20. That is, the load generators 30 of the apparatus 100 are controlled via the control device 40 to adjust the load applied to cable 21 during extension of the cable 21 to the extended state and/or during retraction of the cable 21 to the retracted state. In this way, the load applied to the cable 21 by the electric motors 31 may be held constant, and/or increased, and/or decreased as the cable 21 is extended under the force applied by the user and/or as the cable 21 is retracted against the resistance force applied by the user. The adjustability of the load over the stroke or movement of the cable 21 in this way enables the training to be tailored to an individual user, but also to the specific exercise being trained and its biomechanics. So, each load generator 30 is able to be controlled to provide eccentric loading, concentric loading, and/or isometric loading, as desired.

According to a further embodiment of the present invention, a force measurement device (not shown) may be utilised to measure force applied to the cable 21. One example of a suitable force measurement device is a strain gauge, however any other device which measures force applied to an object is suitable. In use, the control device 40 controls the output of the motor 31, which applies tension on the cable 21. The force measurement device measures the force on the cable 21 and transmits such measurement to the control device 40. The control device 40 may then adjust instructions to the motor 31, so as to increase or reduce tension on the cable 21 as desired. Measurement by the force measurement device may occur continuously, or at set intervals (for example at startup or shutdown of the apparatus 100). Further, adjustment of the output of motor 31 may occur at regular intervals, or at discrete times as determined by control device 40.

According to another embodiment of the fitness training apparatus 100 P. Straps 21 (as illustrated in FIG. 4) may be connected with the ends of a bar 29 for a user to perform 'squat' exercises. Further, handle 24 may be in the form of a cuff for use on a forearm of a user for performing 'arm curl' exercises. In a further improvement of the present invention the fitness training apparatus 100 may be combined with a user device, such as a display monitor and/or a smart phone. The user device is configured for communication with the apparatus 100, preferably via the control device, for the input of training settings by the user (e.g. via a smart phone or similar device) and/or for displaying training information to the user during training. In this regard, a software application installed on the user device for communication with the apparatus 100 for input of training settings and display of training information to the user. Furthermore, the control device 40, and particularly the processor 41, of the apparatus 100 is configured to calculate training performance based on the use of each cable 21 sensed or detected by the sensors 43 of the control device 40 for displaying the performance information on the user device 200. In this way, the control device 40 may output information to the user device for display to the user during training, thereby providing useful training feedback.

In a "velocity targeting" training mode, a speed band or speed range for motion of the cables 21 is employed to set or determine whether the workout is high intensity or low intensity. The lower the velocity target, the slower and heavier (the load) the user is lifting. In this regard, it is useful to target a band or range rather than a specific number or the load tends to waver up and down around the target. Speed is preferably set on a 1 ms pwm signal and the speed is sensed and adjusted every 50 ms. This could also optionally be lowered. The load may be varied linearly, or according to another function (e.g. a log function) if the motion falls out of the target band. Previous settings may also be stored to use as starting points.

The present invention may be configured for internet connectivity either via the control device 40 in the apparatus 100 and/or via the software application installed on the user device. This allows for connecting the user of the fitness training apparatus 100 to an interactive fitness environment. That is, the user can receive audio and/or visual input for one or more training regimes via the user device, and the user may be connected via a display monitor to a group or class training environment—either real or virtual. This input to the user may, for example, be in the form of instructor images (pre-recorded or real-time video) providing instruction and motivation transmitted onto the display monitor for any of various training regimes that may be selected by the user. The present invention may also have an interface for interaction with third party partner devices (e.g. Fitbit™, Apple™, Android™) for biometric review (e.g. of weight, BMI, heart-rate).

The present invention may include one or more accessory devices for user input (such as a camera and/or a microphone) and/or for output to the user (such as loud-speakers and/or lighting). In this regard, a camera enables external monitoring and/or review or social interaction, and a microphone provides for verbal communication by the user with training partners during training. The accessory devices may be integrated in the user device or may be separate. The present invention may also include a remote control (e.g. in addition to touch-screen actuation), optionally with IR input, and power/volume control for a user to operate the user device and/or accessory device(s) remotely during use of the fitness training apparatus 100.

The fitness training apparatus 100 could optionally be produced in a range of models having different load capabilities (e.g. light duty and heavy duty). To this end, the models could have same base 10 (i.e. the same frame 14 and casing 15) but with different motors 31; e.g. with force capacity of 500 N (e.g. approx. 50 kg) per cable 21; or with a force capacity of 1000 N (e.g. approx. 100 kg) per cable 21. The apparatus 100 of this embodiment preferably uses: Teknic MCVC integral HP single phase servo motors 31 in torque following mode; Velocio PLC and HMI screen; US Digital E6 optical incremental encoder; T10 16 mm steel core synchronous polyurethane belting and sprockets; Aluminium frame members 19, 19'. Cable connection ports (HDMI and USB) may be provided. An accessory shelf or pocket may be provided, e.g. for a drink-bottle, towel, phone, key, or the like.

In a further improvement of the present invention, illumination or other visible markers may be provided on the outside casing of the fitness training apparatus 100. These visible markers may serve to communicate to the user, or to any observers, the status of the fitness training apparatus. For example, in the case of illumination, the intensity or color of the illumination may indicate a user's progression in a set or repetition of an exercise.

Figure 11:
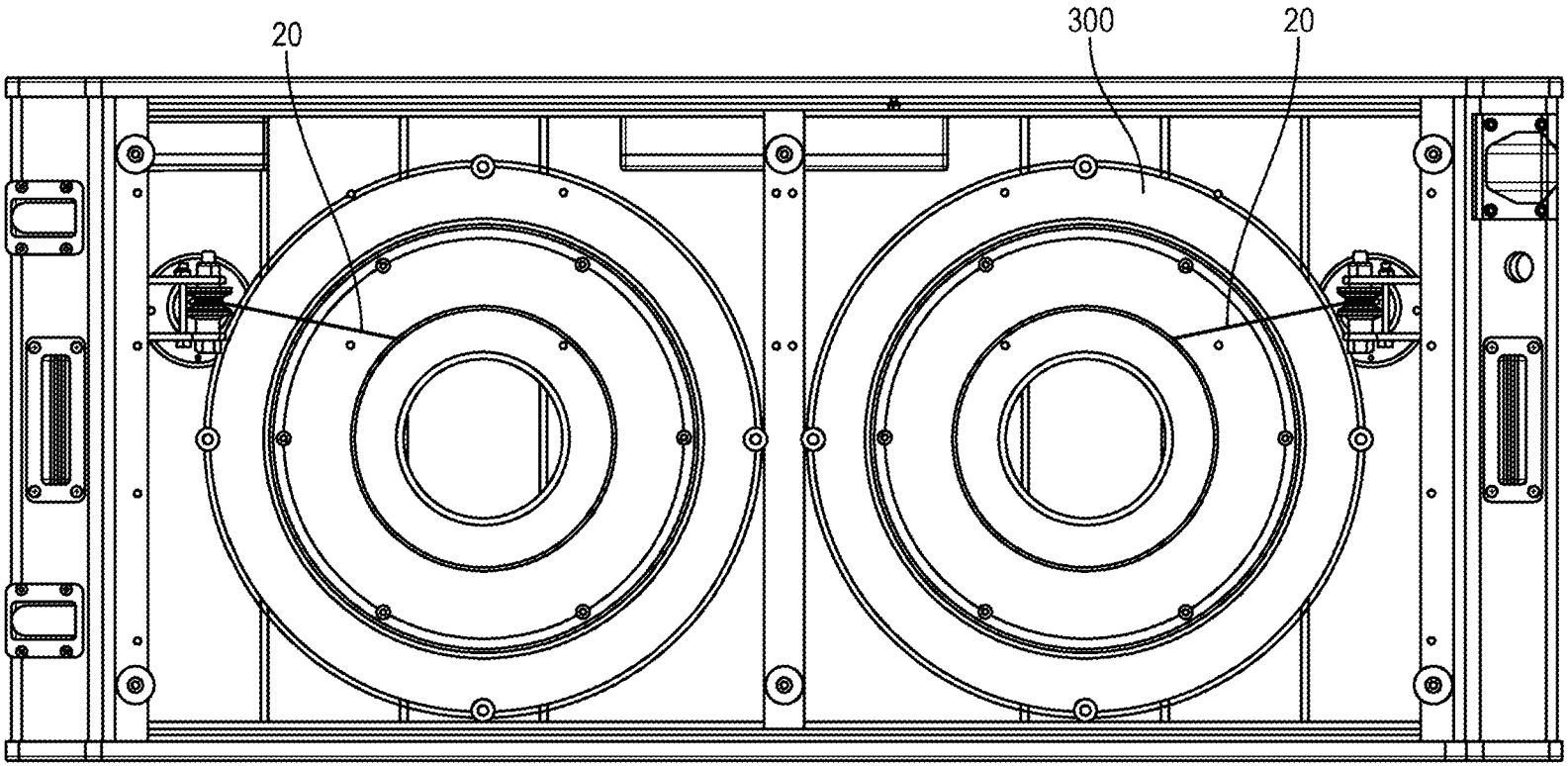
FIG. 11 is a schematic view of the fitness training apparatus according to one embodiment of the present invention which utilises a direct drive motor.

In a further improvement of the present invention, shown in FIG. 11, a direct drive motor 300 may be utilised in place of motor 31. A direct drive motor 300 is a form of motor which does not require a gear box, or pulley 26. The retractable line 20 is driven directly from the direct drive motor 300. The benefits of such a system include increased efficiency due to reduced friction over a traditional motor, reduced noise, a longer lifetime, and higher torque at lower revolutions per minute. Many forms of direct drive motors are suitable for the present invention, including but not limited to, frameless torque motors, brushless permanent-magnet synchronous motors, servo motors, and linear motors.

While the present invention described above will be understood to be directly applicable to use in the health and fitness sector, it will also be appreciated that they will be applicable or useful in the field of physical rehabilitation (e.g. following surgery or recovery from accident), as well as in the field of research, especially in relation to biomechanics and sport science.

Although specific embodiments of the invention are illustrated and described herein, it will be appreciated by persons of ordinary skill in the art that a variety of alternative and/or equivalent implementations exist. It should be appreciated that each exemplary embodiment is an example only and is not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that the terms "comprise", "comprising", "include", "including", "contain", "containing", "have", "having", and any variations thereof, used in this document are intended to be understood in an inclusive (i.e. non-exclusive) sense, such that the process, method, device, apparatus, or system described herein is not limited to those features, integers, parts, elements, or steps recited but may include other features, integers, parts, elements, or steps not expressly listed and/or inherent to such process, method, process, method, device, apparatus, or system. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects. In addition, reference to positional terms, such as "lower" and "upper", used in the above description are to be taken in context of the embodiments depicted in the figures, and are not to be taken as limiting the invention to the literal interpretation of the term but rather as would be understood by the skilled addressee in the appropriate context.

What is claimed is:

1. A fitness training apparatus comprising:

a base having an upper surface configured to support a user during a workout with the fitness training apparatus;

a first retractable line extendable by the user upward from the base against a variable load from a first load generator and retractable to wind up on a first spool or drum; and a second retractable line extendable by the user upward from the base against a variable load from a second load generator and retractable to wind up on a second spool or drum, wherein the first and second load generators comprise corresponding first and second direct drive motors that lie flat in the base with respective vertical axes, and the first and second direct drive motors are provided in separate halves of the base, wherein the first and second load generators act independently on the first and second retractable lines and respectively spool the first and second retractable lines in mirror image in top plan view.

2. A fitness training apparatus comprising:

a base;

a first retractable line and a second retractable line provided in or on the base, the first and second retractable lines each having a free end region for operation by a user, wherein the first and second retractable lines are each configured and arranged to be extended from a retracted state in or on the base to an extended state upon application of a force to the free end region of each of the first and second retractable lines by the user, wherein, in the retracted state, the first and second retractable lines are respectively wound around a first spool or drum and a second spool or drum provided in or on the base;

a first load generator and a second load generator provided in or on the base for respectively applying a selectively adjustable load to the first and second retractable lines, wherein the selectively adjustable loads respectively applied to the first and second retractable lines by the first and second load generators resist or act against the forces respectively applied to the free end regions by the user for respectively extending the first and second retractable lines from the retracted state to the extended state; and a controller for operating the first and second load generators to respectively apply the selectively adjustable loads to the first and second retractable lines, wherein the controller modifies the selectively adjustable loads respectively applied to the first and second retractable lines by the first and second load generators, and wherein the first and second load generators each comprise an electric motor operable to apply a force to the corresponding spool or drum, wherein the electric motor has a vertical axis of rotation.

3. The fitness training apparatus of claim 2, wherein the electric motor is a direct drive motor.

4. The fitness training apparatus of claim 2, wherein the base provides a training platform for the user, upon which the user may stand, sit, or lie while performing training exercises, wherein the training platform is configured as a step.

5. The fitness training apparatus of claim 4, wherein the vertical axis of rotation of the electric motor extends through the training platform.

6. The fitness training apparatus of claim 2, wherein each electric motor is a torque motor that is variably operable to generate a range of torques for applying the selectively adjustable load to the corresponding retractable line.

7. The fitness training apparatus of claim 6, wherein each torque motor is a direct drive motor motor that is variably operable to generate a range of torques for applying the selectively adjustable load to the corresponding retractable line.

8. The fitness training apparatus of claim 2, wherein each retractable line is flexible and is arranged to retract into a wound or coiled configuration in the retracted state.

9. The fitness training apparatus of claim 2, wherein each retractable line is configured and arranged to be extended from the retracted state in a direction away from the base, in an upwards or vertical direction, through a range of angles to the vertical direction, or in a horizontal direction.

10. The fitness training apparatus of claim 2, wherein each retractable line is configured for attachment of a handle at c10 thereof for manual operation by the user.

11. The fitness training apparatus of claim 2, wherein each load generator is configured or controlled to adjust the selectively adjustable load applied to the the corresponding retractable line during one or more of extension of the corresponding retractable line to the extended state or retraction of the corresponding retractable line to the retracted state.

12. The fitness training apparatus of claim 2, wherein the first and second retractable lines are arranged spaced apart from one another by a distance and wherein the base is adjustable to vary the distance by which the first and second retractable lines are spaced apart from one another.

13. The fitness training apparatus of claim 2, wherein each retractable line is provided or incorporated in the base, with the free end region of each retractable line emerging from an outer surface of the base for access and operation by the user.

14. The fitness training apparatus of claim 2, wherein a path of travel of each retractable line is guided by one or more pulleys mounted in or on the base, wherein a pulley for guiding the path of travel of each retractable line into the retracted state is configured to pivot or swivel to promote even spooling of each retractable line as it retracts.

15. The fitness training apparatus of claim 2, wherein the controller is provided in or on the base, the controller having one or more sensors for sensing use or operation of each retractable line, including sensing one or more of a current position, a motion, a speed, or an extension of each retractable line, wherein the controller is configured to adjust the selectively adjustable load respectively applied to each retractable line by the corresponding load generator in dependence on the use or operation of said each retractable line.

16. The fitness training apparatus of claim 15, wherein the one or more sensors comprise at least a rotary encoder for detecting rotation of each spool or drum for determining the current position of the corresponding retractable line as it is extended from or retracted onto the spool or drum.

17. The fitness training apparatus of claim 2, further comprising:

a force measurement device to measure the selectively adjustable load respectively applied to the corresponding retractable line, and wherein the controller modifies the selectively adjustable load respectively applied to the corresponding retractable line by the corresponding load generator based on the selectively adjustable load measured by the force measurement device.

18. The fitness training apparatus of claim 2, wherein the controller is configured for communication with a user device for one or more of input of training settings by the user or displaying training information to the user during training.

19. A fitness training apparatus comprising:

a base having an upper surface configured to support a user during a workout with the fitness training apparatus;

a first retractable line extendable by the user upward from the base against a variable load from a first load generator and retractable to wind up on a first spool or drum; and a second retractable line extendable by the user upward from the base against a variable load from a second load generator and retractable to wind up on a second spool or drum, wherein the first and second load generators comprise corresponding first and second direct drive motors that lie flat in the base with respective vertical axes, wherein the first and second load generators act independently on the first and second retractable lines and respectively spool the first and second retractable lines.

* * * * *